United States Patent [19]

Simpson

[11] Patent Number: 4,485,987

[45] Date of Patent: Dec. 4, 1984

[54] HOLDER FOR THE CORE OF A YARN PACKAGE OR THE LIKE

[75] Inventor: Willie T. Simpson, Rockford, Ill.

[73] Assignee: Barber-Colman Company, Rockford, Ill.

[21] Appl. No.: 538,262

[22] Filed: Oct. 3, 1983

[51] Int. Cl.[3] ..... B65H 49/02; D03J 5/08

[52] U.S. Cl. ..... 242/130.1

[58] Field of Search ..... 242/129.5, 129.7, 129.8, 242/130, 130.1, 139, 72 R, 72.1, 110, 110.1, 110.2; 279/2 R, 1 R, 1 A; 269/47, 48.4

[56] References Cited

U.S. PATENT DOCUMENTS

| | | | |
|---|---|---|---|
| 2,258,262 | 10/1941 | Ross | 242/130 |
| 2,283,373 | 5/1942 | Krafft | 242/130 |
| 2,623,710 | 12/1952 | Pearson | 242/130 |
| 2,681,189 | 6/1954 | Huber | 242/130 |
| 3,617,011 | 11/1971 | Kostelecky et al. | 242/130 |
| 3,659,803 | 5/1972 | Barski | 242/130 |
| 3,850,394 | 11/1974 | Raasch et al. | 242/129.7 |
| 3,897,915 | 8/1975 | Budzyna | 242/130 |
| 4,039,159 | 8/1977 | Champagne | 242/130.1 |
| 4,050,649 | 9/1977 | Haag | 242/130.1 |

*Primary Examiner*—Leonard D. Christian

*Attorney, Agent, or Firm*—Leydig, Voit, Osann, Mayer & Holt, Ltd.

[57] ABSTRACT

A holder for the core of a yarn package includes a spindle, a conical base slidable and rotatable on the inner end portion of the spindle and an anchor in the form of a nose cone threaded on the free end portion of the spindle, the spindle being mounted on a support on the machine in which the holder is used. A plurality of flexible linkages connect the base and the anchor to turn together while permitting each to move axially independently of the other. A spring acts between the support and the base to urge the latter toward to anchor and flex the linkage resiliently outwardly against the inside of the core. The initial flexing of the linkages is adjusted to accommodate cores of different sizes by turning the anchor to move it toward or away from the base.

10 Claims, 4 Drawing Figures

HOLDER FOR THE CORE OF A YARN PACKAGE OR THE LIKE

BACKGROUND OF THE INVENTION

The present invention relates to a holder for a package of yarn in a textile machine such as a creel with the hollow core of the package received on the holder. More particularly, the invention relates to a holder that includes a plurality of linkages which are flexed to bear against the inside of the core and hold the latter in place. The linkages are pivotally connected to a base and to an anchor or nose cone which are axially spaced apart on a spindle and which are relatively movable toward and away from each other to flex the linkages into and out of engagement with the inside of the core.

SUMMARY OF THE INVENTION

The general object of the invention is to provide a new and improved holder of the foregoing type in which the linkages resiliently bear against the inside of the core and in which the linkages when once set are capable of receiving successive cores of the same size and still resiliently hold each core.

A more detailed object is to achieve the foregoing by mounting the base to slide axially on the spindle and by employing a spring to urge the base toward the anchor so that, by acting through the base, the spring resiliently urges surfaces on the linkages against the inside of the core.

Another object is to thread the anchor on the spindle so that, by turning the anchor, the latter may be moved toward and away from the base to adjust the initial flexing of the linkages for different size cores.

The invention also resides in the details of the construction of the base, the anchor and the linkage.

DETAILED DESCRIPTION OF THE PREFERRED EMBODIMENT

Figure 1:
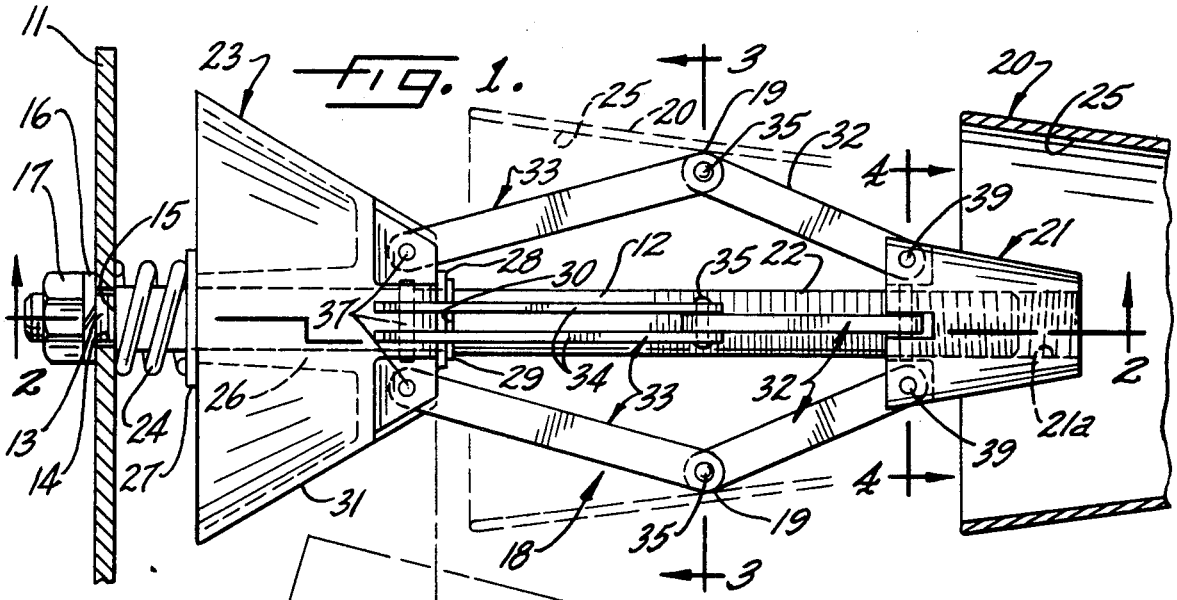
FIG. 1 is a side view of a holder embodying the novel features of the present invention.

As shown in the drawings for purposes of illustration, the invention is embodied in a holder for a package 10 of yarn such as is customarily used in a textile machine known as a creel (not shown). The holder is mounted on a support plate 11, which usually is a rigid part of the frame of the creel or other machine with which the holder is used, and the holder includes an elongated spindle 12 projecting outwardly from the plate. To attach the spindle to the plate, one end portion 13 of the spindle is reduced in diameter and is threaded and this end portion projects through a hole 14 in the plate with the resulting shoulder 15 on the spindle abutting the plate. The spindle then is secured to the plate by a lock washer 16 and a nut 17 threaded on the end portion 13. The holder also includes a plurality of linkages 18, herein four, angularly spaced around the spingle and each providing an outwardly facing surface 19. The core 20 of the package 10 is slipped over the spindle and the linkages are flexed to move the surfaces 19 radially outward, that is, the total surface of the linkages is expanded so that it is engaged by the inner side of the core. The core may be cylindrical or, as illustrated, it may be conical and cores of different diameters are accommodated by the flexing of the linkages.

The present invention contemplates the provision of a novel holder in which the linkages resiliently engage the interior of the core 20, in which the surfaces 19 on the linkages may be easily adjusted to receive cores of different sizes and in which, once the linkages are adjusted, the linkages receive successive cores of the same size while still resiliently engaging the cores. To this end, the linkages connect an anchor member 21 on the free end 22 of the spindle 12 and a base 23 slidably received on the other end portion of the spindle and a spring 24 acts between the support plate 11 and the base to urge the base toward the anchor. As a result, the spring acts through the base to flex the linkages in a direction to move the surfaces 19 radially outwardly and thereby resiliently urges these surfaces against the inner surface 25 of the core.

In the form shown in the drawings, the base 23 is a molded plastic cone having a central cylindrical boss 26 slidably received on the spindle 12 adjacent the support plate 11 and the spring 24 is a coiled compression spring encircling the spindle between the plate and a washer 27 which is on the spindle and which abuts the inner end of the boss. Thus, the spring urges the base outwardly and outward sliding of the base is limited by engaging a second washer 28 which is on the spindle and which abuts a snap ring 29 received in a groove 30 in the spindle. The base is formed to present an outwardly facing conical surface 31 which is engaged by the end of the core 20 and, due to its conical shape, centers the core on the holder irrespective of the size of the core so long as the radius of the core is within the limits of the surface. The anchor 21 is in the form of a nose cone and also is a molded plastic piece with a central bore 21*a* receiving the outer end portion 22 of the spindle. The anchor is small enough that the smallest core to be used with the holder easily fits over the anchor and, preferably, the bore 21*a* and the end portion 22 of the spindle are threaded so that the axial position of the anchor relative to the base may be adjusted simply by turning the anchor.

Figure 3:
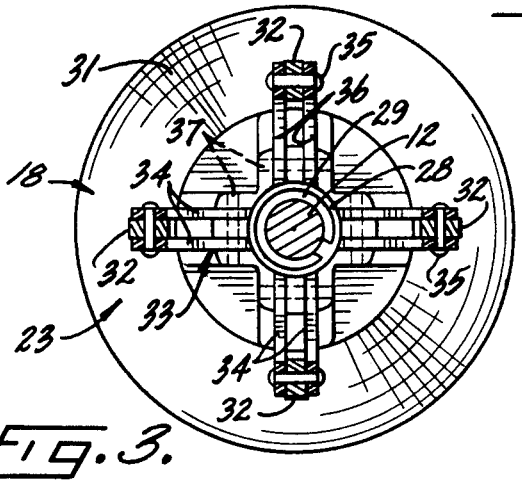
FIG. 3 is a sectional view taken along the line 3—3 in FIG. 1.
Figure 4:
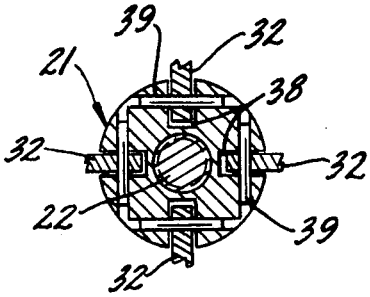
FIG. 4 is a sectional view taken along the line 4—4 in FIG. 1.

The four linkages 18 are identical and are equally spaced around the spingle 12 and each includes two links 32 and 33, the link 33 herein being made up of two spaced parallel bars 34 (FIGS. 1 and 3). At the adjacent ends of the links, the bars 34 straddle the link 32 and are pivotally connected to the latter by a transverse pin 35. At their other end, the bars project into slots 36 (FIG. 3) in the base and the bars are pivotally connected to the base by a pin 37. Similarly, the outer end of the link 32 is received in a slot 38 (FIG. 4) in the anchor 21 and is pivotally connected to the latter by a pin 39, the axes of the pins 35, 37 and 39 of each linkage being parallel. The ends of the links are rounded and each link is inclined so that the connecting pin 35 is spaced farther from the spindle 12 than are the pins 37 and 39. The edges of the adjacent ends of the link 32 and the bars 34 form the surface 19 on each of the linkages 18. Thus, when the base 23 slides toward the anchor 21, the linkages collapse with the result that the surfaces 19 move radially outwardly and the composite surface formed by all of these surfaces expands. The same result occurs when the anchor is threaded in on the spindle toward the base.

Conversely, the linkages straighten and the composite surface collapses when the base and the anchor are moved toward each other.

Figure 2:
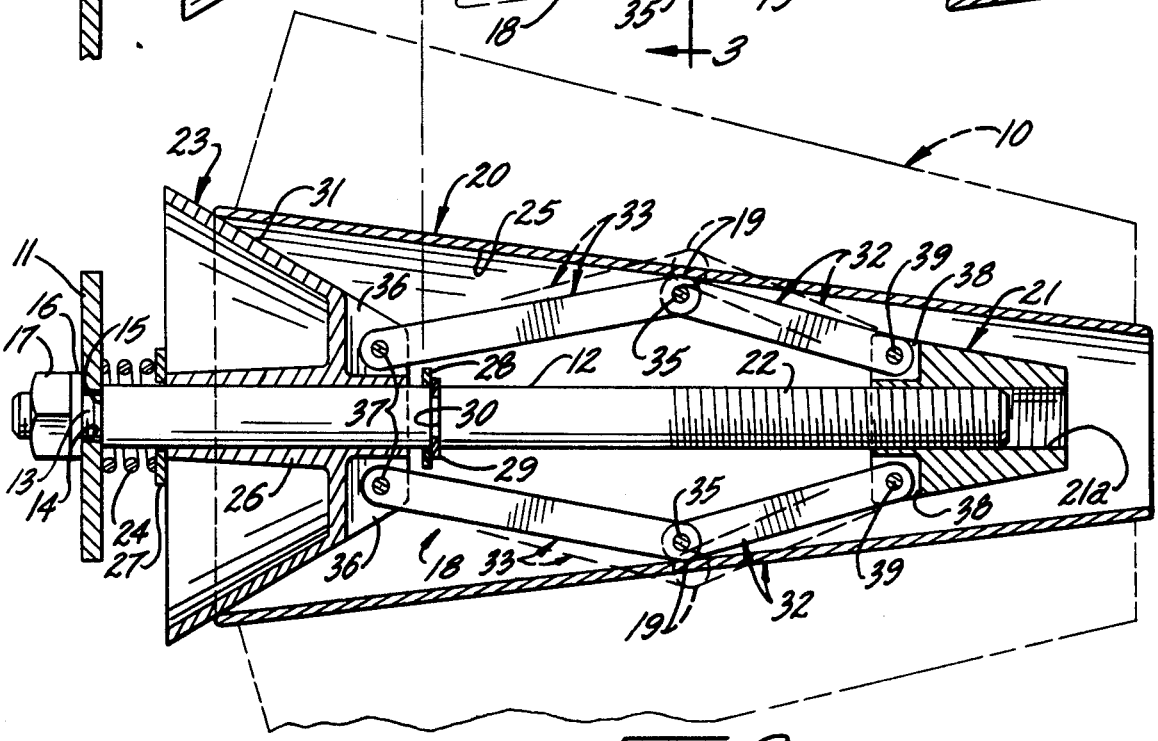
FIG. 2 is a sectional view taken along the line 2—2 in FIG. 1.

With the foregoing arrangement, the base 23 normally is held against the washer 28 by the spring 24 and, assuming that the anchor 21 is in the proper position on the spindle 12 for the size core 20 of a package 10 to be used, the linkages 18 are flexed to a degree such that the surfaces 19 are spaced from the spindle a greater distance than they will be when the core is in place on the holder. Thus, with the conical core shown in FIGS. 1 and 2, the radial spacing of the surfaces is less than the internal radius of the core at its larger end but it also is great enough to engage the core before the latter is seated against the base as illustrated in broken lines in FIG. 1. As the core is advanced further and into engagement with the base, it gradually flexes the linkages inwardly from the original or broken line position in FIG. 2 to the final position shown in solid lines. Because the anchor is stationary on the spindle at this time, such flexing slides the base axially toward the support plate 11 against the action of the spring 24 whereby the spring urges the linkages outwardly and resiliently biases the surfaces 19 against the inside surface 25 of the core to hold the core in place on the holder. When the package has been used, the core is removed and a package with a new core is placed on the holder in the same manner.

If a core 20 of a different size is to be used, the anchor 21 may be threaded in or out on the spindle 12 to flex the linkages 18 outwardly or inwardly as may be required to place the surfaces 19 in a position radially spaced from the spindle a distance somewhat greater than they will be when the core is in place so that these surfaces will resiliently bear against the surface 25 in the manner described above. It is preferred, however, to utilize the core of the package to effect an initial adjustment to the desired size. Thus, the anchor 21 first is threaded out on the post 12 until the surfaces 19 are well inside their ultimate positions. Then, the core is placed on the holder with its inner end abutting against the base 23. Because the surface 31 on the base is conical, there is good frictional engagement between this surface and the end of the core. Accordingly, while the core is pressed inwardly against the conical surface, it is also turned clockwise as viewed in FIG. 3 and this causes the base to turn in the same direction on the post. Because the linkages 18 effectively cause the base and the anchor to turn together, this turning of the core results in a corresponding turning of the anchor in the direction to thread the anchor inwardly and expand the linkages against the inside of the core. After the surfaces 19 engage the core, continued turning causes the base to slide inwardly away from the washer 28 and to compress the spring 24 so that the latter causes the surfaces to engage the core with an increasing force. The turning is continued until this force reaches the desired magnitude. At any time thereafter, the core may be removed from the holder and replaced with another core of the same size without further adjustment of the core.

I claim:

1. A holder adapted to be mounted on a support and to receive a tubular core, said holder comprising, an elongated spindle mounted on said support, an annular base slidably received on said spindle coaxially with the latter, an anchor member supported on said spindle and axially spaced from said base, linkage means connecting said base and said anchor member and operable to permit the base to slide on said spindle toward and away from the anchor member, said linkage means providing a surface which faces radially outwardly of said spindle and which expands and contracts respectively as said base is moved toward and away from said anchor member, said surface being adapted to receive a tubular core and to engage the interior thereof, and a spring acting between said base and said support to urge the base toward said anchor member thereby to resiliently expand said surface against the interior of the core.

2. A holder as defined in claim 1 including means to limit the sliding of said base toward said anchor member.

3. A holder as defined in claim 1 including means for supporting said anchor member on said spindle for selective axial adjustment toward and away from said base.

4. A holder as defined in claim 3 in which said means for supporting said anchor member includes a threaded portion on said spindle and a threaded axial bore formed in the anchor member and receiving the threaded portion of the spindle.

5. A holder as defined in claim 1 in which said anchor member is threaded on said spindle for axial adjustment toward and away from said base, said base being rotatable on said spindle, and said linkage means connecting said base and said anchor member for turning together whereby turning the base axially adjusts the anchor member.

6. A holder as defined in claim 1 in which said base includes a conical surface which receives and centers the core.

7. A holder adapted to be mounted on a support and to receive a tubular core, said holder comprising, an elongated spindle mounted on and projecting from said support and having a free end portion, an annular base slidably received on said spindle coaxially with the latter and disposed adjacent said support, an anchor member mounted on the free end portion of said spindle and axially spaced from said base, a plurality of linkages disposed between said base and said anchor member and angularly spaced around said spindle, each of said linkages including first and second links pivotally connected together at their adjacent ends with their opposite ends pivotally connected to said base and said anchor member respectively to permit said base to slide on said spindle toward and away from said anchor member, the links of each of said linkages being inclined outwardly away from said spindle toward the connection between the links and the connections between the links providing a surface which faces radially outwardly and which expands and contracts as said base is moved toward and away from said anchor member, said surface being adapted to receive a tubular core and to engage the interior thereof when an end of the core engages said base, and a spring acting between said base and said support to urge the base toward said anchor member to resiliently expand said surface against the interior of the core.

8. A holder adapted to be mounted on a support and to receive a tubular core, said holder comprising, an elongated spindle mounted on and projecting from said support and having a free end portion, an annular base slidably received on said spindle coaxially with the latter and disposed adjacent said support, an anchor member adjustably threaded on the free end portion of said spindle and axially spaced from said base, a plurality of linkages disposed between said base and said anchor member and angularly spaced around said spindle, each of said linkages including first and second links pivotally connected together at their adjacent ends with their opposite ends pivotally connected to said base and said anchor member respectively to permit said base to slide on said spindle toward and away from said anchor member and to permit the anchor member to be threadedly adjusted on the spindle toward and away from the base, the links of each of said linkages being inclined outwardly away from said spindle toward the connection between the links and the connections between the links providing a surface which faces radially outwardly and which expands and contracts as said base and said anchor member are moved relatively toward and away from each other, said surface being adapted to receive a tubular core and to engage the interior thereof when an end of the core engages said base, and a spring acting between said base and said support to urge the base toward said anchor member to resiliently expand said surface against the interior of the core, said anchor member being adjustable on said spindle to adjust the diameter of said surface whereby the latter may receive cores of different internal diameter, said base also being rotatable on said spindle and connected by said linkages to said anchor member to turn with the latter whereby the anchor member may be adjusted on the spindle by utilizing the core to turn the base.

9. A holder as defined in claim 8 in which said base includes a conical surface projecting into and engaged by the core to center the core on said spindle and to frictionally grip the core whereby the core turns the base and thus turns said anchor member.

10. A holder as defined in claim 8 including an abutment on said spindle and engageable with said base to limit the axial sliding of the base toward said anchor member.

* * * * *